US006510108B2

(12) United States Patent
Ogasawara

(10) Patent No.: US 6,510,108 B2
(45) Date of Patent: Jan. 21, 2003

(54) ELECTRONIC TIMEPIECE

(75) Inventor: Kenji Ogasawara, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/767,451

(22) Filed: Jan. 23, 2001

(65) Prior Publication Data

US 2001/0019517 A1 Sep. 6, 2001

(30) Foreign Application Priority Data

Feb. 10, 2000 (JP) ..... 2000-33317

(51) Int. Cl.[7] ..... G04B 19/20; G04B 19/24

(52) U.S. Cl. ..... 368/37; 368/28; 368/36

(58) Field of Search ..... 368/28, 34–37

(56) References Cited

U.S. PATENT DOCUMENTS 4,282,592 A * 8/1981 Miyasaka ..... 368/221
5,903,519 A * 5/1999 Takahashi et al. ..... 368/35
6,088,301 A * 7/2000 Tomoharu ..... 368/28

* cited by examiner

*Primary Examiner*—David Martin
*Assistant Examiner*—Michael L. Lindinger
(74) *Attorney, Agent, or Firm*—Adams & Wilks

(57) ABSTRACT

An electronic timepiece has a date wheel for undergoing rotation in accordance with movement of an indicator to change a display state of a date display, a 24 hour wheel driven to undergo one complete rotation each 24 hour period in accordance with movement of the indicator, and a contact spring connected to the 24 hour wheel for rotation therewith. A circuit board has first and second electrode patterns electrically connected to each other by the contact spring. A switching circuit changes a voltage level of the first electrode pattern to a first voltage level. A detector outputs an initializing signal corresponding to detection of termination of an operation for interchanging a battery of the electronic timepiece or for correcting time. A controller inputs the initializing signal from the detector to place the switching circuit in an ON state for a preselected period of time when the voltage level of the first electrode pattern reaches a second voltage level supplied to the second electrode pattern during the preselected period of time. The controller places the switching circuit in an OFF state when the specific rotational position of the contact spring is detected, starts a first counting operation at intervals of 24 hours by a predetermined clock pulse, and rotates the date wheel to change a display state of the date display each time a result of the first counting operation reaches a value indicating elapse of 24 hours.

7 Claims, 6 Drawing Sheets

ELECTRONIC TIMEPIECE

BACKGROUND OF THE INVENTION

1. Field of the Invention

The present invention relates to an electronic timepiece having a date wheel for advancing control of the electronic timepiece, and particularly to an electronic timepiece using both a mechanical system for detecting a mechanical position of a 24 hour wheel and an electronic system for counting an indicator of the timepiece for detecting date switching time.

2. Description of the Prior Art

In an electronic timepiece of so-to-speak analog display, it is currently general to mount a calendar mechanism which is recognized by a user as a naturally provided function. Generally, there is known a calendar mechanism having a display mode in which a window is provided at the 3 o'clock position on a dial and numerals are viewed from inside of the window or a display mode in which month and date are indicated by an indicator as in time display.

In either of the above-described display modes, the display state indicating month or date is changed in accordance with change of actual date or month and accordingly, the date switching time needs to be detected. The change of the display state is realized by feed control of a date wheel operating through movement of a numeral disk or an indicator. In order to detect the date switching time, generally, there is adopted a mechanical system or an electronic system.

According to the mechanical system, an electrode is attached orthogonally to a shaft of a 24 hour wheel constituting one of the front train wheels and the electrode is brought into contact with a specific electrode pattern on a circuit board functioning also as a bearing of the 24 hour wheel to thereby detect the date switching time. For example, the above-described electrode is formed in a strip-like shape the center of which is disposed at the shaft of the 24 hour wheel and both ends of the electrode conduct electricity between two electrode patterns which are separated from each other on the same circular rim of the circuit board to thereby detect the date switching time.

Meanwhile, according to the electronic system, pulses for controlling the indicators of the timepiece are electronically counted with the date switching time as a reference and it is monitored whether a counted result reaches a predetermined number of pulses in correspondence with elapse of 24 hours and the reached time point is detected as the date switching time.

However, according to the conventional electronic timepiece, in detecting the date switching time by the mechanical system, generally, voltage (Vdd) of a logical level "H" is applied to one of the above-described two electrode patterns and it is necessary to monitor whether CPU makes the change to the logical level state of voltage of the other electrode pattern (hereinafter, referred to as detecting terminal), that is, the logical level "H".

In this case, a signal inputted to the CPU via the detecting terminal needs to stably maintain the logical level without undergoing influence of noise. Hence, normally, there is constructed a constitution in which a pull-down resistor is connected to the detecting terminal and a signal at "L" level is always inputted to the side of CPU in a state other than detecting the date switching time. Therefore, there is brought about a state in which power is always dissipated via the pull-down resistor although the dissipated power is very small and the dissipation of power influences on the life of a battery for a wrist watch or the like driven by a small-sized battery.

Meanwhile, according to the conventional electronic timepiece, in detecting the date switching time by the electronic system, when a battery is interchanged, in order to set a reference of counting pulses, it is necessary to inform the indicator position giving current time to CPU, which is difficult to realize for the electronic timepiece having operating means of only a winding stem for correcting time.

The invention has been carried out in view of the above-described and it is an object thereof to provide an electronic timepiece which is capable of resolving the problem of power dissipation in the mechanical system by also using an electronic system in addition to the mechanical system and which is capable of accurately detecting date switching time with no need of special operation after changing the battery or correcting time using the winding stem.

SUMMARY OF THE INVENTION

In order to achieve the above-described object, according to an aspect of the invention, there is provided an electronic timepiece which is an electronic timepiece having a calendar function by a feed control of a date wheel, the electronic timepiece comprising a 24 hour wheel rotating by once per day based on movement of an indicator such as an hour hand by way of a train wheel, a contact spring fixed to the 24 hour wheel to rotate in connection with the 24 hour wheel and having conductivity (corresponding to a contact spring 43, mentioned later), a circuit board formed with a first electrode pattern (corresponding to a detecting terminal 41, mentioned later, hereinafter, referred to as detecting terminal) and a second electrode pattern (corresponding to an electrode 42, mentioned later, hereinafter, referred to as electrode) electrically connected to each other by the contact spring only at a specific rotational position (date switching position) of the contact spring, a switching circuit (corresponding to a pull-down resistor 52 and an NMOS transistor 53, mentioned later) to pull up or pull down a voltage level of the detecting terminal to a first voltage level (power source potential Vdd or ground potential) in a case of an ON state, and controller (corresponding to CPU 10, mentioned later) to bring the switching circuit into the ON state only for a predetermined period of time and advancing the date wheel when the voltage level of the detecting terminal reaches a second voltage level (voltage different from first voltage level and ground potential or power source potential Vdd) supplied to the electrode in the predetermined period of time.

According to an aspect of the invention, in detecting the rotational position of the contact spring above the 24 hour wheel, the controller brings the detecting terminal into a state of being supplied with the ground potential or the power source potential Vdd via the pull-down resistor or the pull-up resistor by the switching circuit only for a necessary predetermined time period and accordingly, for example, when reliability of detection of the date switching time is to be improved when using the above-described electronic system also, detection of the date switching time by the mechanical system can be actuated only when necessary.

Further, according to another aspect of the invention, there is provided the electronic timepiece further comprising a detector (corresponding to the operation of a winding stem, mentioned later) for detecting termination of the operation of interchanging a battery or correcting the time and outputting an initializing signal, wherein the controller brings the switching circuit into the ON state when the initializing signal is inputted, brings the switching circuit into an OFF state when a specific rotational position of the contact spring is detected, starts a counting operation at intervals of 24 hours by a predetermined clock pulse and advances the date wheel at every time at which the result of the counting operation reaches a value indicating elapse of 24 hours.

According to an aspect of the invention, detection of the date switching time by the mechanical system is carried out only in the initialized state after changing a battery or correcting time which is detected by the detector and thereafter, by the controller, the operation of pulling up or pulling down causing dissipation of power in the mechanical system is removed by bringing the switching circuit into the OFF state and the operation can proceed to detection of the date switching time by the electronic system.

Further, according to another aspect of the invention, there is provided an electronic timepiece wherein the controller starts a counting operation different from the counting operation of 24 hours by the predetermined clock pulse when the switching circuit is brought into the OFF state and executes a processing the same as a processing in a case in which the initializing signal is inputted to the controller also when the result of the counting operation reaches a predetermined value.

According to an aspect of the invention, also in the case of operation other than the operation by the user such as interchanging a battery or correcting time, in the electronic timepiece which is brought into a state of detecting the date switching time by the electronic system, when the predetermined time period is counted by the controller, detection of the date switching time by the mechanical system can automatically be carried out.

According to another aspect of the invention, there is provided the electronic timepiece, further comprising detector for detecting termination of an operation of interchanging a battery or correcting time and outputting an initializing signal, wherein the controller brings the switching circuit into an ON state when the initializing signal is inputted, starts a counting operation of 24 hours by a predetermined clock pulse when a specific rotational position of the contact spring is detected, successively stores the result of the counting operation correcting the previous value every time the specific rotational position of the contact spring is detected, brings the switching circuit into an OFF state when the result of the counting operation stored reaches a predetermined number of times (for example, 3 times), corrects the determination standard of the counting operation of 24 hours by using the stored correction value, starts again the counting operation at intervals of 24 hours and thereafter advances the date wheel at every time at which the result of the counting operation reaches the determination standard.

According to an aspect of the invention, in the initialized state after interchanging a battery or correcting time which is detected by the detector, detection of the date switching time by the mechanical system is carried out only for a certain fixed time period (constant number of times), counting by the electronic system is simultaneously carried out and the result of counting in the time period of executing the mechanical system can be collected. Accordingly, thereafter, the determination standard value for counting 24 hours can be adjusted based on the collected result of the counting and when the mechanical system is shifted to the electronic system, the date switching time can be detected more accurately.

BRIEF DESCRIPTION OF THE DRAWINGS

A preferred form of the present invention is illustrated in the accompanying drawings in which.

DETAILED DESCRIPTION OF THE PREFERRED EMBODIMENTS

A detailed explanation will be given of embodiments of an electronic timepiece according to the invention with reference to the drawings as follows. Further, the invention is not limited by the embodiments described herein.

(Embodiment 1)

Figure 1:
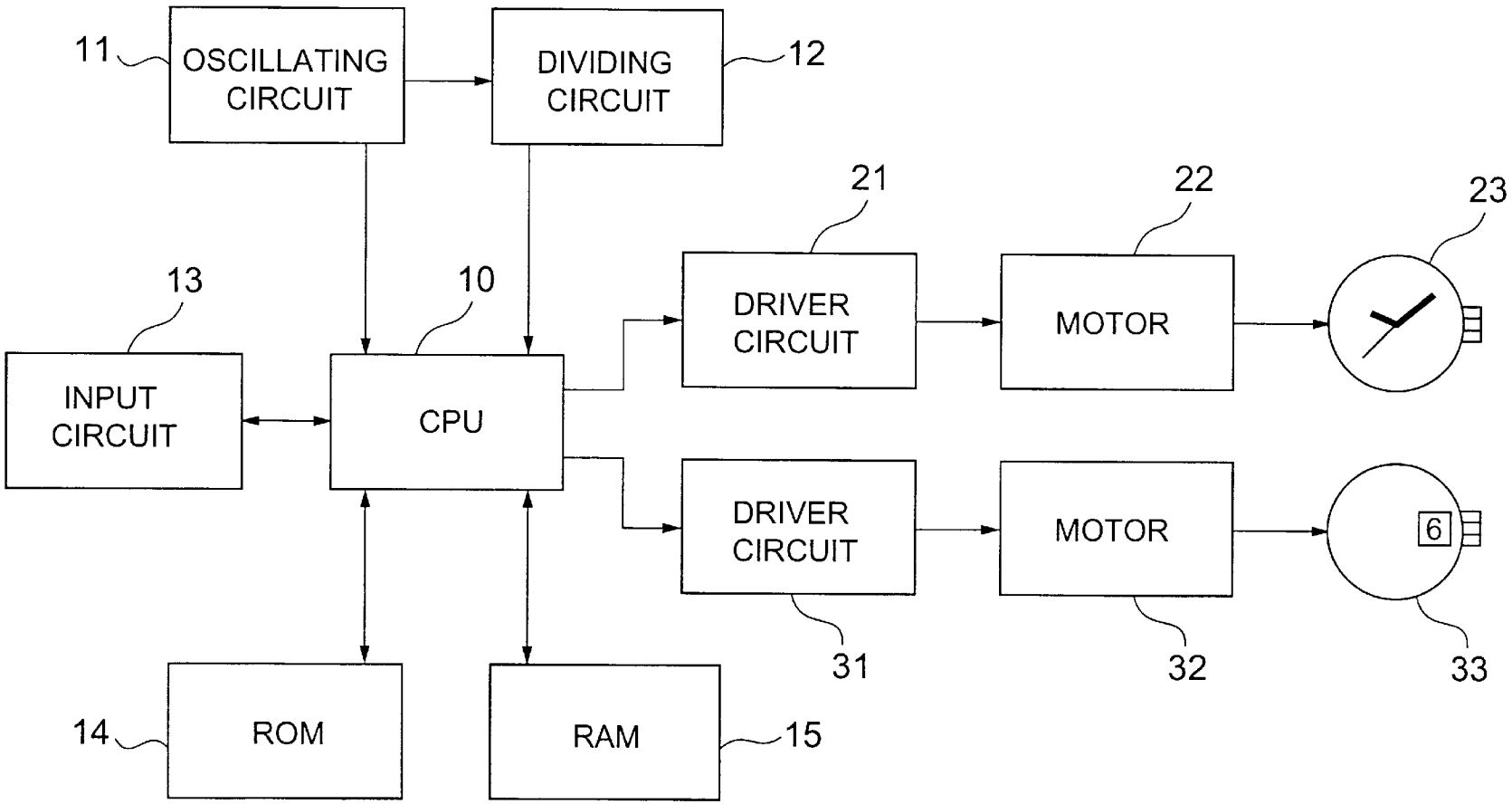
FIG. 1 is a block diagram showing an outline constitution of an electronic timepiece according to Embodiment 1.

FIG. 1 is a block diagram showing the construction of an electronic timepiece according to Embodiment 1. In FIG. 1, an electronic timepiece according to Embodiment 1 comprises CPU 10, an oscillating circuit 11, a dividing circuit 12, an input circuit 13, ROM 14, RAM 15, driver circuits 21 and 31 and motors 22 and 32.

Here, CPU 10 controls to govern the whole of the electronic timepiece and realizes various functions by executing programs in synchronism with a system clock. A control of driving a date wheel in accordance with detection of date switching time, mentioned later, is executed by CPU 10. Further, the programs or various data are previously stored in ROM 14 and RAM 15.

The oscillating circuit 11 generates an oscillating signal having a predetermined frequency constituting a basis of operational timings of the electronic timepiece and supplies the oscillating signal to CPU 10 as the above-described system clock and outputs the oscillating signal to the dividing circuit 12.

Further, the dividing circuit 12 divides the oscillating signal inputted from the oscillating circuit 11 to thereby generate a clock having a predetermined cycle, particularly, a reference clock (pulse of unit of second) for driving an hour hand, a minute hand and a second hand.

The input circuit 13 corresponds to a light button when a backlight function is added, buttons for setting various functions when digital display is also used, or a start/stop button when a chronograph function is provided, which includes detection whether the winding stem is pulled out or pushed in.

The driver circuit 21 is for outputting a drive pulse for driving the motor 22 and particularly for amplifying a pulse at every second inputted from CPU 10 to current necessary for driving the motor 22. By the drive control of the driver circuit 21, power of the motor 22 moves a hour hand/minute hand/second hand 23 after having been slowed by front train wheels and rotates a 24 hour wheel by one rotation per day.

Also the drive circuit 31 outputs a drive pulse for driving the motor 32 similar to the driver circuit 21 and amplifies the drive pulse inputted from CPU 10 to current necessary for driving the motor 32. By the drive control of the driver circuit 31, power of the motor 32 is transmitted to a date wheel to thereby change date display or month display 33.

Figure 2B:
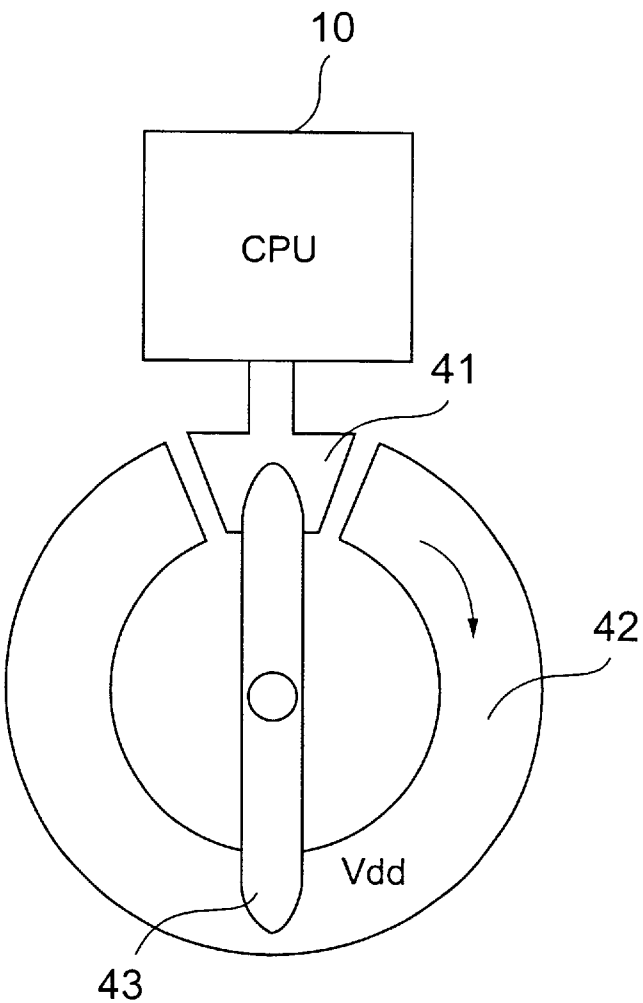
FIG. 2 illustrate explanatory views for explaining detection of date switching time by a mechanical system according to the electronic timepiece of Embodiment 1.
Figure 2A:
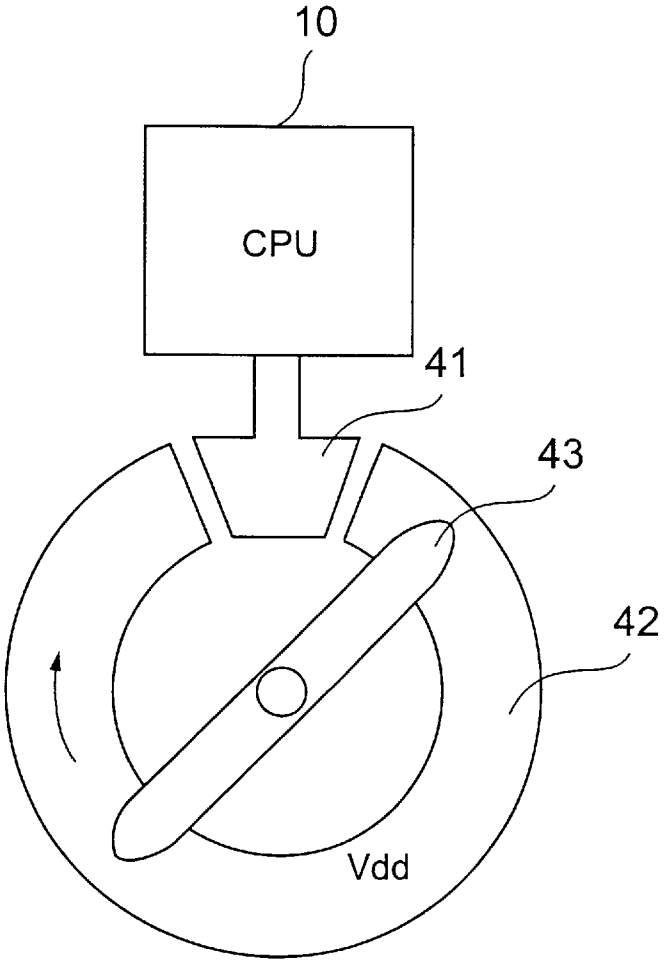

FIGS. 2A and 2B are explanatory views for explaining detection of date switching time by a mechanical system in the electronic timepiece according to Embodiment 1, particularly showing the 24 hour wheel and various electrode portions. In FIGS. 2A and 2B, both a detecting terminal 41 and an electrode 42 are electrode patterns formed on a circuit board arranged with the above-described various circuits and are formed separate from each other on the same circular band as illustrated. Further, a center of the ring formed by the detecting terminal 41 and the electrode 42, functions also as a bearing of the 24 hour wheel.

Here, the detecting terminal 41 is connected to CPU 10, a logical level state thereof is monitored and the electrode 42 is applied with voltage (Vdd) indicating a logical level "H".

Further, a contact spring 43 shown in FIGS. 2A and 2B, is formed in a strip-like shape attached orthogonally to a shaft of the above-described 24 hour wheel and rotated along with the 24 hour wheel and constituting a length along its long axis of about the diameter of the above-described ring and is provided with conductivity. Further, the contact spring 43 is brought into contact with the detecting terminal 41 or the electrode 42 at both ends thereof and plays a role of electrically connecting the detecting terminal 41 and the electrode 42 at a specific rotational position.

FIG. 2A shows a state in which the both ends of the contact spring 43 are brought into contact with the electrode 42 and FIG. 2B shows a state in which one end of the contact spring 43 is brought into contact with the detecting terminal 41 and other end thereof is brought into contact with the electrode 42.

Figure 3:
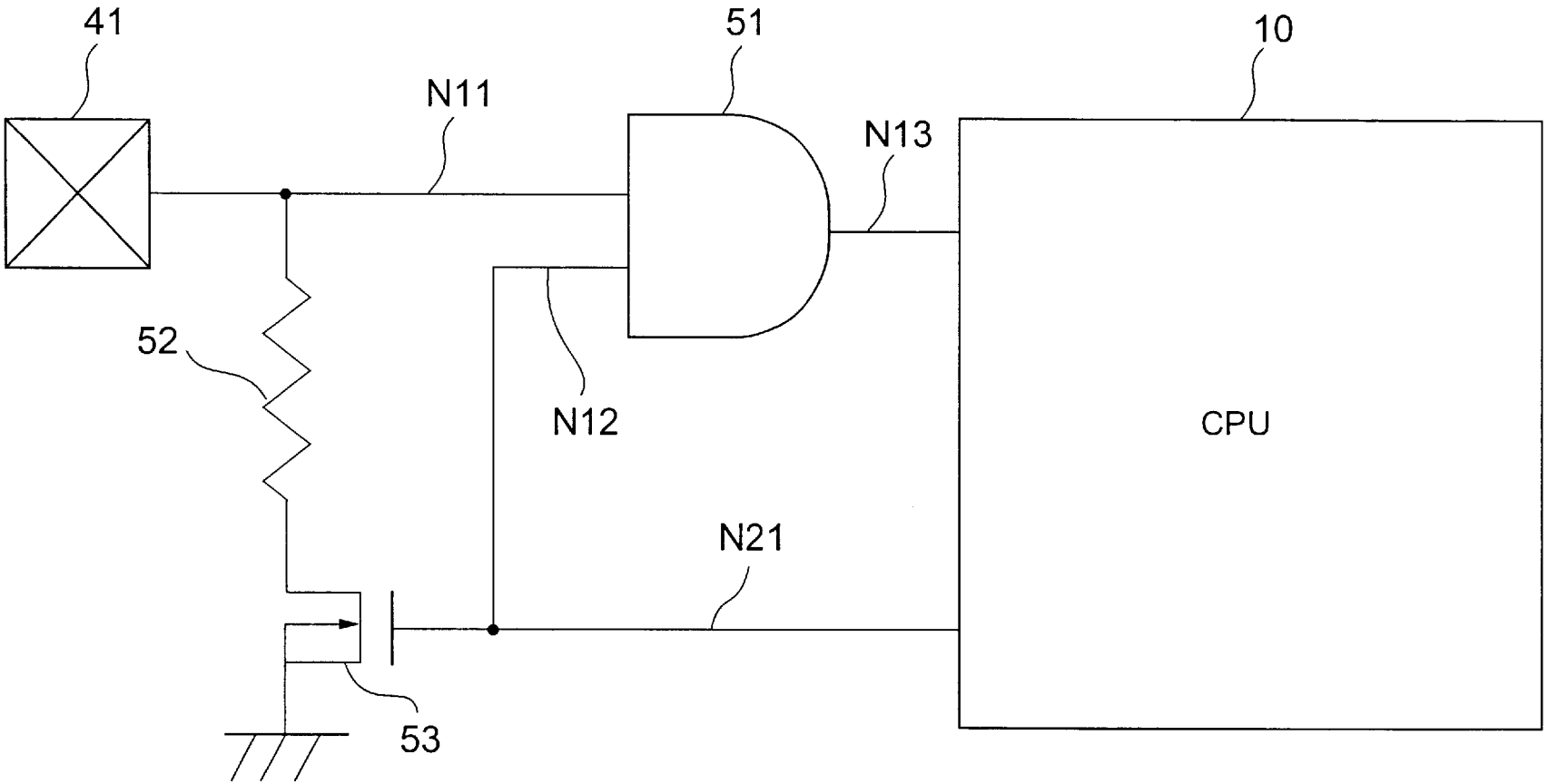
FIG. 3 is a diagram showing a constitution of a circuit provided between CPU and a detecting terminal according to the electronic timepiece of Embodiment 1.

FIG. 3 is a diagram showing a constitution of a circuit provided between CPU 10 and the detecting terminal 41, particularly showing the characteristic of the invention. In FIG. 3, the AND gate 51 has one input terminal N11 connected to the detecting terminal 41 and the other input terminal N12 connected to an output terminal N21 of CPU 10. Further, one end of a pull-down resistor 52 is connected to the detecting terminal 41.

Further, an NMOS transistor 53, has a source connected to the ground potential, a drain connected to the other end of the pull-down resistor 52 and a gate connected to the output terminal N21 of CPU 10, mentioned above.

Here, an explanation will be given of detection of date switching time by the mechanical system in the electronic timepiece according to Embodiment 1 in reference to FIG. 2 and FIG. 3. The detection operation is on the premise that when date switching time detecting conditions are satisfied, CPU 10 outputs the logical level "H" signal to the output terminal N21.

Accordingly, thereby, the NMOS transistor 53 is brought into an ON state and other end of the pull-down resistor 52 is connected to the ground potential. Further, under this state, firstly, consider a case in which both ends of the contact spring 43 are brought into contact with the electrode 42 as shown by the state of FIG. 2A, that is, a state in which voltage Vdd is not supplied to the detecting terminal 41.

Under this state, the detecting terminal 41 indicates a logical level "L" due to connection with the ground potential via the pull-down resistor 52 shown in FIG. 3 and the input terminal N11 of the AND gate 51 is inputted with this "L" signal. Thereby, the AND gate 51 outputs a signal of the logical level "L" from an output terminal N13 regardless of the logical level indicated by the input terminal N12. By inputting the signal of the logical level "L", CPU 10 determines that the 24 hour wheel, that is, the hour hand does not reach the predetermined position of the date switching time (for example, the position of 0 o'clock ) as shown by FIG. 2A.

Meanwhile, in the case in which one end of the contact spring 43 is brought into contact with the detecting terminal 41 and other end thereof is brought into contact with the electrode 42 as in the state of FIG. 2B, that is, in a state in which the detecting terminal 41 is supplied with voltage Vdd, the detecting terminal 41 indicates the logical level "H" and a signal of the logical level "H" is inputted to the input terminal N11 of the AND gate 51.

Thereby, the AND gate 51 outputs a signal of the logical level "H" from the output terminal N13 since the signal inputted to the input terminal N12 coincides with the signal of the logical level "H" outputted from the output terminal N21 of CPU 10. By inputting the signal of the logical level "H", CPU 10 determines that the 24 hour wheel, that is, the hour hand reaches the predetermined position of date switching time (in this case, position of 0 o'clock) as shown by FIG. 2B.

Further, although in FIGS. 2A and 2B, the logical level of the detecting terminal 41 changes to "H" at every 12 hours, in this case, CPU 10 counts twice the logical level "H" of the detecting terminal 41 and gives drive pulses to the driver circuit 31 such that the date wheel is rotated by an angle in correspondence with one day. Further, there may be constructed a constitution in which the logical level of the detecting terminal 41 becomes "H" every 24 hours by fixing the contact spring to a gear the speed of which is slowed down from the speed of the 24 hour wheel. However, in the following explanation, to facilitate understanding, the state of the logical level "H" of the detecting terminal 41 indicates rotation of one day of the date wheel.

Figure 4:
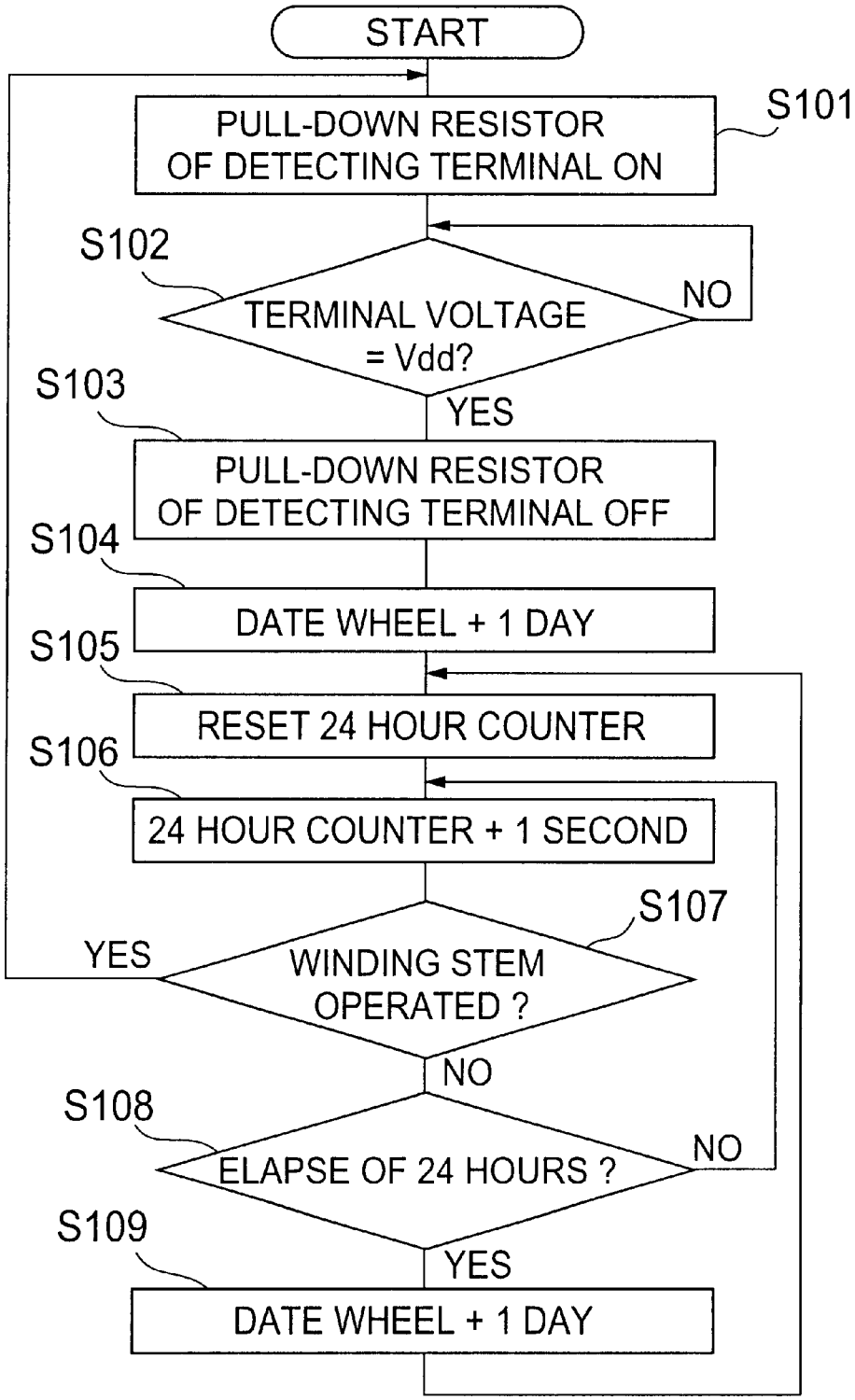
FIG. 4 is a flowchart showing date wheel control operation according to Embodiment 1.

Next, an explanation will be given of control operation of the date wheel according to the electronic timepiece of Embodiment 1. FIG. 4 is a flowchart showing control operation of the date wheel according to Embodiment 1. In the following explanation, in this case, assume a case in which the electronic timepiece is reset by interchanging a battery or the like and thereafter, a user carries out accurate time setting (time correction) by a winding stem or the like. The interchange of the battery and the time correction correspond to the above-described date switching time detecting conditions.

Further, the winding stem is provided with, for example, two states of pulled 0 steps out and 1 step out, where the state of 0-steps indicates a normal time display state and a state of 1-step pulled indicates a time correcting state and these states of the winding stem can be detected by CPU 10. Therefore, in the state of 1-step pulled of the winding stem operation of the timepiece is stopped, and operation of the timepiece is continued by maintaining the 0-stage state.

First, CPU 10 outputs a signal of the logical level "H" to the output terminal N21 shown in FIG. 3 because it detects that interchange of a battery has been finished. That is, the pull-down resistor 52 of the detecting terminal 41 has been brought into an ON state (step S101). Therefore, as described above, the logical level of a signal inputted to CPU 10 via the output terminal N13 of the AND gate 51, is brought into a state of being dependent upon the logical level of the detecting terminal 41. Further, detection of finishing interchange of a battery can be realized by utilizing, for example, an initializing signal produced by the interchange of a battery. Further, comparing with the state in which an effective battery is charged, the case in which a state of the winding stem is changed from the 1-stage pulled state to the 0-stage state, mentioned above, that is, a state in which time correction has been finished, is similar.

Further, it is determined whether the detecting terminal 41 is of the logical level "H", that is, whether terminal voltage is equal to the voltage Vdd (step S102). The determination is repeated until the terminal voltage shifts to voltage Vdd.

That is, the state is maintained until the date switching time is reached for the first time after the user carries out time correction.

At step S102, when the terminal voltage is determined to coincide with the voltage Vdd, that is, when the date switching time is detected by the mechanical system, CPU 10 outputs a signal of the logical level "L" to the output terminal N21 and brings the pull-down resistor 52 of the detecting terminal 41 into an OFF state (step S103).

Thereafter, CPU 10 rotates the date wheel by one day by generating the drive pulses to the driver circuit 31 (step S104) and initializes the 24 hour counter (step S105). Next, the 24 hour counter is incremented (step S106) and it is determined whether operation of the winding stem was carried out by the user (step S107).

The operation of the winding stem indicates operation in the 1-step pulled state, mentioned above. That is, by this determination, it is detected that the user intends to correct a shift of time caused by operation for a long period of time through the winding stem and when it is detected that the winding stem operation has been done, the processing returns to step S101.

At step S107, when it is determined that winding stem operation is not being done, it is then determined whether the 24 hour counter has reached a value indicating elapse of 24 hours (step S108). At step S108, when it is not determined that 24 hours has elapsed, the processing returns to step S106 and increment of the 24 hour counter is continued.

At step S108, when it is determined that 24 hours has elapsed, that is, when the date switching time is detected by the electronic system, The CPU 10 rotates the date wheel by one day by generating the drive pulses to the drive circuit 31 (step S109). Thereafter, the processing returns to step S105 and the processing for deciding whether to rotate the date wheel is repeated again.

As has been explained above, according to the electronic timepiece of Embodiment 1, in the initialized state after interchanging a battery, firstly, the pull-down resistor 52 is brought into the ON state and the date switching time is detected by the mechanical system, after detecting the date switching time, the pull-down resistor 52 is brought into the OFF state, detection of the date switching time by the electronic system is continued and accordingly, in normal use of the timepiece other than such an initialized state, power dissipation by the pull-down resistor can be avoided and in a wrist watch or the like, the life of operation by a small-sized battery can be prolonged.

(Embodiment 2)

Next, an explanation will be given of an electronic timepiece according to Embodiment 2. The electronic timepiece according to Embodiment 2 is characterized in that whereas the electronic timepiece according to Embodiment 1 detects the date switching time by the mechanical system only when a battery is interchanged or when time is corrected, after elapse of a predetermined time period (for example, 1 week), the date switching time is again detected automatically by the mechanical system. However, operation of Embodiment 2 differs from that of Embodiment 1 only in the operation of the flowchart shown by FIG. 4, and other basic operation explained in reference to FIG. 2 and FIG. 3 remains unchanged and accordingly, an explanation thereof will be omitted here.

Figure 5:
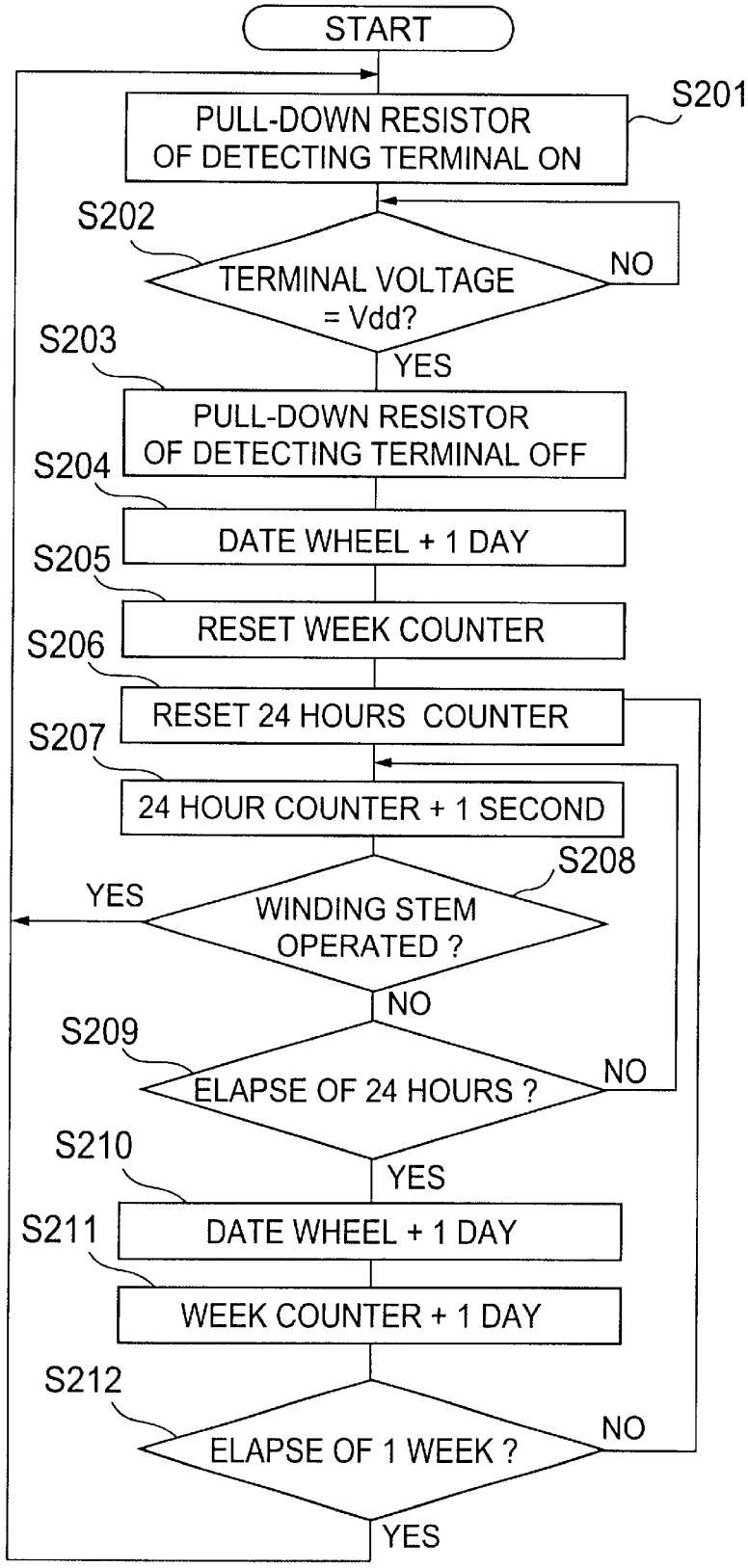
FIG. 5 is a flowchart showing date wheel control operation according to Embodiment 2.

FIG. 5 is a flowchart showing control operation of the date wheel according to Embodiment 2. In the following explanation, there is assumed an initialized state similar to that in Embodiment 1. In the initialized state, firstly, CPU 10 detects that interchange of a battery has been finished and brings the pull-down resistor 52 of the detecting terminal 41 into an ON state by outputting the logical level "H" to the output terminal N21 shown in FIG. 3 (step S201).

Further, it is determined whether the detecting terminal 41 indicates the logical level "H", that is, whether the terminal voltage is equal to the voltage Vdd (step S202). The determination is repeated until the terminal voltage changes to the voltage Vdd. That is, the state is maintained until the date switching time is reached for the first time after the user carries out time correction.

At step S202, when it is determined that the terminal voltage is equal to the voltage Vdd, that is, when the date switching time is detected by the mechanical system, CPU 10 outputs a signal of the logical level "L" to the output terminal N21 and brings the pull-down resistor 52 of the detecting terminal 41 into an OFF state (step S203).

Thereafter, CPU 10 rotates the date wheel by one day by generating drive pulses to the driver circuit 31 (step S204), initializes a week counter (step S205) and initializes the 24 hour counter (step S206). Successively, the 24 hour counter is incremented (step S207), and it is determined whether the winding stem was operated by the user (step S208). At this occasion, when it is detected that the winding stem is operated, the processing returns to step S201.

At step S208, when it is determined that the winding crown was not operated, successively, it is determined whether the 24 hour counter reaches a value indicating elapse of 24 hours (step S209). At step S209, when it is not determined that 24 hours has elapsed, the processing returns to step S207 and increment of the 24 hour counter is continued.

At step S209, when it is determined that 24 hours has elapsed, that is, the date switching time is detected by the electronic system, CPU 10 rotates the date wheel by one day by generating the drive pulses to the driver circuit 31 (step S210). Successively, the week counter is incremented (step S211) and it is determined whether the week counter reaches a value indicating elapse of one week (step S212). At step S212, when it is not determined that one week has elapsed, the processing returns to step S206 and the processing from initializing the 24 hour counter is repeated. At step S212, when it is determined that one week has elapsed, the processing returns to step S201.

As has been explained above, according to the electronic timepiece of Embodiment 2, in addition to the initialized state after interchanging a battery or the like, at every predetermined time period of one week or the like, the date switching time is determined by the mechanical system by bringing the pull-down resistor 52 into the ON state, and after the detection the pull-down resistor 52 is brought into the OFF state and detection of the date switching time by the electronic system is continued and accordingly, power consumption by the pull-down resistor in operation of the mechanical system is minimized, thereby, the life of operation by a small-sized battery can be prolonged and by periodically executing the mechanical system, even when chattering of the contact spring 43 and the detecting terminal 41 is caused, shift of the count value by the electronic system can be corrected.

(Embodiment 3)

Next, an explanation will be given of an electronic timepiece according to Embodiment 3. The electronic timepiece according to Embodiment 3 is characterized in that whereas the electronic timepiece according to Embodiment 1 detects the date switching time by the mechanical system one time only when a battery is interchanged or when time is corrected, the mechanical system of Embodiment 3 is operated a predetermined number of times, there is calculated an average value of detected values of the 24 hour counter by the detecting terminal 41, the 24 hour counter is corrected by using the result of the calculation and thereafter, the operation proceeds to detection of the date switching time by the electronic system. Further, operation according to Embodiment 3 differs from that of Embodiment 1 only in the operation of the flowchart shown by FIG. 4, whereas other basic operations explained in reference to FIG. 2 and FIG. 3 remain unchanged and accordingly, an explanation thereof will be omitted here.

Figure 6:
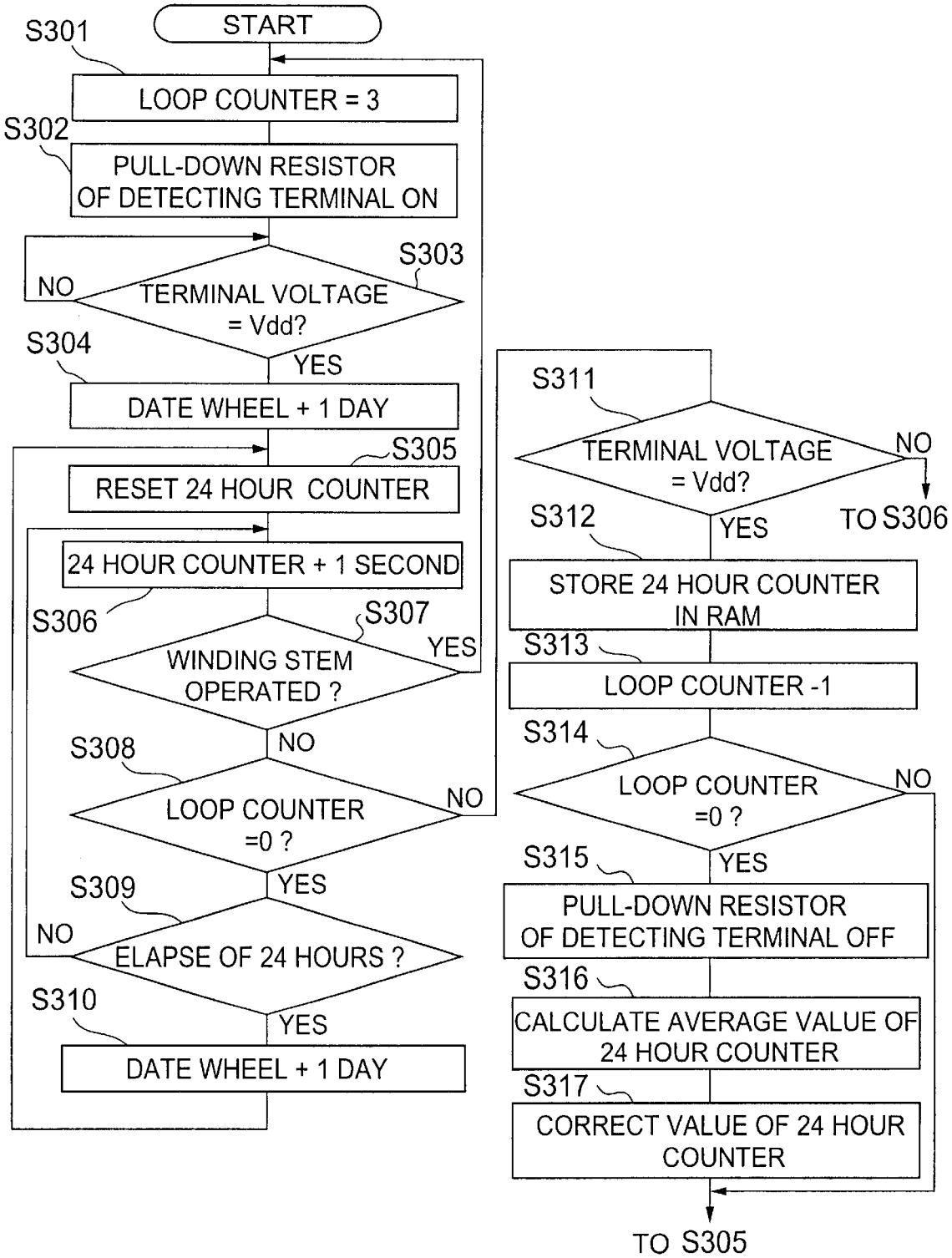
FIG. 6 is a flowchart showing date wheel control operation according to Embodiment 3.

FIG. 6 is a flowchart showing control operation of the date wheel according to Embodiment 3. In the following explanation, an initialized state similar to that in Embodiment 1 is assumed. In the initialized state, firstly, CPU 10 detects that interchange of a battery has been finished and thereafter initializes a loop counter for setting the number of times to execute the mechanical system (step S301). In this case, the number of times to execute the mechanical system is set to three and 3 is inputted to the loop counter.

Successively, by inputting a signal of the logical level "H" to the output terminal N21 shown in FIG. 3, the pull-down resistor 52 of the detecting terminal 41 is brought into an ON state (step S302). Further, it is determined whether the detecting terminal 41 indicates the logical level "H", that is, whether the terminal voltage is equal to the voltage Vdd (step S303). The determination is repeated until the terminal voltage reaches the voltage Vdd. That is, the state is maintained until the date switching time is reached for the first time after the user corrects time.

At step S303, when it is determined that terminal voltage coincides with the voltage Vdd, that is, when the date switching time is detected initially by the mechanical system, CPU 10 rotates the date wheel by one day by generating drive pulses to the driver circuit 31 (step S304) and initializes the 24 hour counter (step S305). Successively, the 24 hour counter is incremented (step S306) and it is determined whether the winding stem was operated by the user (step S307). At this occasion, when it is detected that the winding stem was operated, the processing returns to step S301.

At step S307, when it is determined that the winding stem was not operated, successively, it is determined whether the above-described loop counter indicates 0 (step S308). At step S308, when the loop counter is not 0, it is determined again whether the detecting terminal 41 indicates the logical level "H", that is, whether the terminal voltage is equal to the voltage Vdd (step S311).

At step S311, when the detecting terminal 41 does not indicate the logical level "H", the processing returns to step S306 and there are executed again increment of the 24 hour counter (step S306), determination of whether the winding stem was operated (step S307) and determination of whether the loop counter is 0 (step S308). That is, the series of processings are repeated until the terminal voltage reaches the voltage Vdd.

At step S311, when it is determined that the terminal voltage coincides with the voltage Vdd, that is, when the date switching time is detected initially by the mechanical system, CPU 10 stores the current value of the 24 hour counter in RAM 15 (step S312) and the loop counter is decremented (step S313).

Successively, it is determined whether the loop counter has reached 0 by the decrementing operation (step S314) and when the loop counter is other than 0, the processing returns to step S305. Further, when the loop counter indicates 0, CPU 10 outputs the signal of the logical level "L" to the output terminal N21 and brings the pull-down resistor 52 of the detecting terminal 41 into the OFF state (step S315).

At this occasion, after the processing of step S315, by the processing at step S312 values of the 24 hour counter of past three times are stored. Hence, the average value of the 24 hour counter is calculated from the stored values (step S316) and there is corrected the reference value by which the 24 hour counter determines whether 24 hours has elapsed by using the result of the calculation (step S317). Thereafter, the processing proceeds again to step S305.

Meanwhile, at step S308, when the loop counter indicates 0, it is determined whether the 24 hour counter reaches a value indicating elapse of 24 hours (step S309). At step S309, when it is not determined that 24 hours has elapsed, the processing returns to step S306 and incrementing operation of the 24 hour counter is continued.

At step S309, when it is determined that 24 hours has elapsed, that is, when the date switching time is detected by the electronic system, CPU 10 rotates the date wheel by one day by generating the drive pulses to the driver circuit 31 (step S310). Further, the processing proceeds again to step S305.

As has been explained above, according to the electronic timepiece of Embodiment 3, the mechanical system is executed by bringing the pull-down resistor 52 into the ON state only after coming into the initialized state, such as after a battery is interchanged, for a predetermined number of times (3 times in the above-described example), and correction is carried out by using the result of counting of the 24 hour counter provided by the above execution in the above time period and thereafter, the operation proceeds to detection of the date switching time by the electronic system and accordingly, power dissipation by the pull-down resistor in operation of the mechanical system is minimized, the life of operation by a small-sized battery can be prolonged and by using the result of counting of the 24 hour counter, even when chattering of the contact spring 43 and the detecting terminal 41 is caused, aberration of the count value by the electronic system can be corrected.

Further, although according to Embodiments 1 through 3, there is constructed a constitution in which the pull-down resistor 52 is connected to the detecting terminal 41 and the level is pulled down to the logical level "L", there may be constructed a constitution in which the electrode 42 is connected to the ground potential and an ON/OFF control is carried out by an MOS transistor such that the level is pulled up via a pull-up resistor at the detecting terminal 41.

As has been explained, according to the electronic timepiece of the invention, in the initialized state after interchanging a battery or the like, the pull-down resistor (or pull-up resistor) is brought into the ON state, the date switching time is detected by the mechanical system and after checking the date switching time, the pull-down resistor (or pull-up resistor) is brought into the OFF state, the operation proceeds to detection of the date switching time by the electronic system and accordingly, there is achieved an effect that in normal use of the timepiece other than the initialized state, power dissipation by the pull-down resistor (or pull-up resistor) can be avoided and in a wrist watch or the like, life of operation by a small-sized battery can be prolonged.

Further, according to the electronic timepiece of the invention, in addition to the initialized state after interchanging a battery or the like, at predetermined time intervals of one week or the like, the pull-down resistor (or pull-up resistor) is brought into the ON state, the date switching time is determined by the mechanical system, and after detecting the date switching time, the pull-down resistor (or pull-up resistor) is brought into the OFF state, the operation proceeds to detection of the date switching time by the electronic system and accordingly, there is achieved an effect that power dissipation by the pull-down resistor by the mechanical system is minimized, the life of operation by a small-sized battery can be prolonged and by periodically executing the mechanical system, even when chattering of the contact spring and the detecting terminal is caused, aberration of the count value of the electronic system can be corrected.

Further, according to the electronic timepiece of the invention, there is executed the mechanical system to bringing the pull-down resistor (or pull-up resistor) into the on state for predetermined number of times only from an initialized state after interchanging a battery or the like, correction is carried out by using the results of counting of the 24 hour counter provided by the above execution for the above time periods and thereafter, the operation proceeds to detection of the date switching time by the electronic system and accordingly, there is achieved an effect that power dissipation by the pull-down resistor (or pull-up resistor) by the mechanical system is minimized, the life of operation by a small-sized battery can be prolonged and even when chattering of the contact spring and the detecting terminal is caused, by using the result of counting of the 24 hour counter, aberration of the count value by the electronic system can be corrected.

What is claimed is:

1. An electronic timepiece comprising:

an indicator mounted for undergoing movement to indicate time;

a date wheel for undergoing rotation in accordance with movement of the indicator to change a display state of a date display;

a 24 hour wheel driven to undergo one complete rotation each 24 hour period in accordance with movement of the indicator;

a contact spring having electric conductivity and connected to the 24 hour wheel for rotation therewith;

a circuit board having a first electrode pattern and a second electrode pattern electrically connected to each other by the contact spring at a specific rotational position of the contact spring;

a switching circuit for changing a voltage level of the first electrode pattern to a first voltage level;

a detector for detecting a termination state of an operation for interchanging a battery of the electronic timepiece or for correcting time displayed by the indicator and for outputting an initializing signal corresponding to the termination state; and a controller for inputting the initializing signal from the detector to place the switching circuit in an ON state for a preselected period of time when the voltage level of the first electrode pattern reaches a second voltage level supplied to the second electrode pattern during the preselected period of time, placing the switching circuit in an OFF state when the specific rotational position of the contact spring is detected, starting a first counting operation at intervals of 24 hours by a predetermined clock pulse, and rotating the date wheel to change a display state of the date display each time a result of the first counting operation reaches a value indicating elapse of 24 hours.

2. An electronic timepiece according to claim 1; wherein the controller starts a second counting operation different from the first counting operation by the predetermined clock pulse when the switching circuit is placed in the OFF state and places the switching circuit in the ON state when a result of the second counting operation reaches a predetermined value.

3. An electronic timepiece according to claim 1; wherein the first and second electrode patterns are angularly spaced from each other about a center of rotation of the contact spring and are disposed to come into contact with the contact spring at different times during rotational movement of the contact spring.

4. An electronic timepiece according to claim 3; wherein the contact spring and the first and second electrode patterns are operable to assume a first detection state in which the contact spring is only in contact with the second electrode pattern and a second detection state in which the contact spring is in contact with both the first and second electrode patterns.

5. An electronic timepiece comprising:

an indicator mounted for undergoing movement to indicate time;

a date wheel for undergoing rotation in accordance with movement of the indicator to change a display state of a date display;

a 24 hour wheel driven to undergo one complete rotation each 24 hour period in accordance with movement of the indicator;

a contact spring having electric conductivity and connected to the 24 hour wheel for rotation therewith;

a circuit board having a first electrode pattern and a second electrode pattern electrically connected to each other by the contact spring at a specific rotational position of the contact spring;

a switching circuit for changing a voltage level of the first electrode pattern to a first voltage level;

a detector for detecting a termination state of an operation for interchanging a battery of the electronic timepiece or for correcting time displayed by the indicator and for outputting an initializing signal corresponding to the termination state; and a controller for inputting the initializing signal from the detector to place the switching circuit in an ON state for a preselected period of time when the voltage level of the first electrode pattern reaches a second voltage level supplied to the second electrode pattern during the preselected period of time, starting a counting operation by a predetermined clock pulse when a specific rotational position of the contact spring is detected, successively storing the result of the counting operation as a correction value each time the specific rotational position of the contact spring is detected, placing the switching circuit in the OFF state when the result of the counting operation is stored a predetermined number of times, correcting a determination reference of whether the result of the counting operation reaches a value indicating elapse of 24 hours using the correction value, starting a counting operation at intervals of 24 hours, and rotating the date wheel to change a display state of the date display each time the result of the counting operation reaches the determination reference.

6. An electronic timepiece according to claim 5; wherein the first and second electrode patterns are angularly spaced from each other about a center of rotation of the contact spring and are disposed to come into contact with the contact spring at different times during rotational movement of the contact spring.

7. An electronic timepiece according to claim 6; wherein the contact spring and the first and second electrode patterns are operable to assume a first detection state in which the contact spring is only in contact with the second electrode pattern and a second detection state in which the contact spring is in contact with both the first and second electrode patterns.

* * * * *